US005136943A

United States Patent [19]

Fischer et al.

[11] Patent Number: 5,136,943

[45] Date of Patent: Aug. 11, 1992

[54] DRIVE FOR MULTI-COLOR ROTARY PRINTING PRESS HAVING MORE THAN SIX PRINTING UNITS

[75] Inventors: Karlheinz Fischer; Arndt Jentzsch; Victor Hefftler, all of Coswig; Olf Lehmann, Heidenau, all of Fed. Rep. of Germany

[73] Assignee: Planeta - Druckmaschinenwerk Aktiengesellschaft, Radebeul, Fed. Rep. of Germany

[21] Appl. No.: 821,994

[22] Filed: Jan. 16, 1992

Related U.S. Application Data

[63] Continuation of Ser. No. 626,948, Dec. 13, 1990.

[30] Foreign Application Priority Data

Dec. 20, 1989 [DE] Fed. Rep. of Germany ..... 3359126

[51] Int. Cl.[5] ..... B41F 13/00; B41F 5/02

[52] U.S. Cl. ..... 101/183

[58] Field of Search ..... 101/181, 182, 183, 216, 101/174, 177, 178, 184, 219, 220, 221, 225, 136, 137, 141

[56] References Cited

U.S. PATENT DOCUMENTS

| | | | |
|---|---|---|---|
| 3,557,692 | 1/1971 | Lee | 101/183 |
| 4,014,259 | 3/1977 | Jeschke | 101/183 |
| 4,493,255 | 1/1985 | Fischer | 101/177 X |
| 4,566,385 | 1/1986 | Tappert et al. | 101/183 |
| 4,811,663 | 3/1989 | Hefftler et al. | 101/183 |
| 4,867,060 | 9/1989 | Hefftler et al. | 101/183 |

FOREIGN PATENT DOCUMENTS

| | | | |
|---|---|---|---|
| 2038718 | 7/1980 | United Kingdom | 101/183 |

*Primary Examiner*—J. Reed Fisher
*Attorney, Agent, or Firm*—Michael J. Striker

[57] ABSTRACT

A drive for and a method of driving of a multi-color rotary sheet printing press with a row of printing units comprising more than six printing units and including feed and delivery units and intermediate printing units, wherein all printing units are connected with each other by gear trains, two adjacent intermediate printing units are driven with different torques, and every other intermediate printing unit in a row of intermediate printing units that follows the two adjacent intermediate printing units, is driven with torque that differs from at least one of the two different torques applied to the two adjacent intermediate printing units.

8 Claims, 3 Drawing Sheets

DRIVE FOR MULTI-COLOR ROTARY PRINTING PRESS HAVING MORE THAN SIX PRINTING UNITS

This is a continuation, of application Ser. No. 626,948 filed Dec. 13, 1990, now abandoned.

BACKGROUND OF THE INVENTION

East German patent 245,167 discloses a drive for multi-color rotary sheet printing presses having up to six printing units, with which, in addition to the delivery printing unit, the feed printing unit and the following printing units are driven.

East German patent 245,166 discloses a drive for multi-color rotary sheet printing presses having up to six printing units, that drives only the intermediate units, and no drive is provided for feed and delivery printing units.

West German patent 2,952,365 discloses a multi-color rotary sheet printing press with six printing units arranged one after another, and in which the power is transmitted between second and third printing units and between fourth and fifth printing units or between first and second printing units and between third and fourth printing units.

These drives cannot be used for printing presses with more than six printing units because either a large number of driving units is needed or, with a reduced number of driving units, because of increase in the driving torque, a substantial loading of the driving elements occurs that results in a premature wear of driving elements and reduced quality of the print.

SUMMARY OF THE INVENTION

The object of the invention is to provide a drive for a multi-color rotary sheet printing press having more than six printing units, which drive will insure a high quality of the print.

Another object of the invention is to provide a drive for a multi-color rotary sheet printing press that will insure a minimal loading of the drive gear trains with a reduced number of the driving elements. The object of the invention is achieved by providing a drive with which two printing units that are alternatively followed by non-driven and driven printing units, are driven with a different power or torque. The driving torque can be applied by a differential, electric motor or hydraulic motor. Such a drive insures a small loading of the drive gear trains whereby the loading of cylinder journals on which gear wheels are supported, are also reduced. This results only in a very small deflection of the cylinder journals so that a quality print is insured. The cost of the drive is reduced because of a reduced number of driving elements, coupling, etc.

The present invention both as to its construction so to its method of operation, together with additional objects and advantages thereof, will be best understood from the following detailed description of specific embodiments when read in connection with the accompanying drawings.

DETAILED DESCRIPTION OF THE PREFERRED EMBODIMENT

Figure 1:
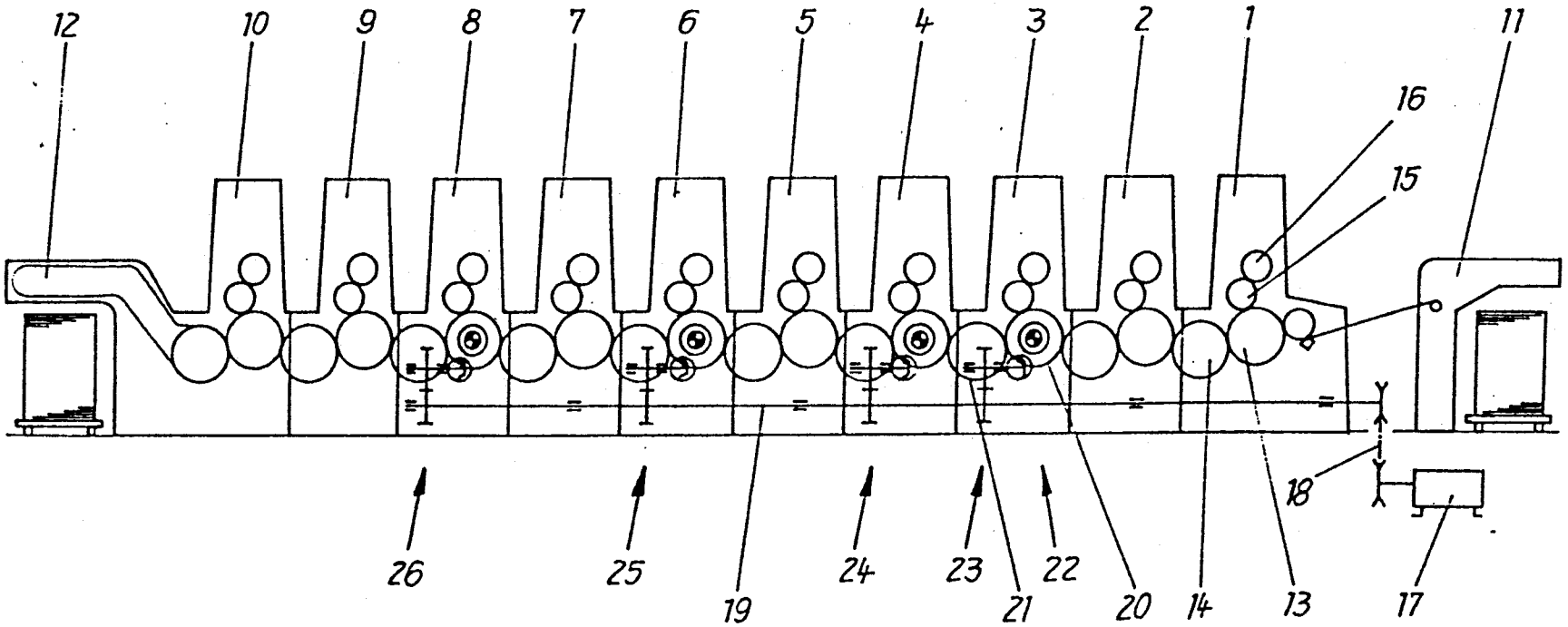
FIG. 1 shows a schematic view of a rotary sheet printing press equipped with drive means according to the invention.

FIG. 1 shows a rotary sheet printing press having ten printing units. The plurality of printing units includes a feed unit 1, eight printing units 2–9 arranged one after another, and a delivery unit 10. The feed unit 1 is connected with a feed table 11, and the delivery unit 10 is connected with a delivery table 12. Each of units 1–10 comprises a printing cylinder 13, a transfer cylinder 14, an impression cylinder 15, and a plate cylinder 16. The drive for the printing press comprises a drive motor 17 for driving a main shaft 19. The drive motor 17 is connected with the shaft by a V-belt drive 18. The printing and transfer cylinders carry respective gear wheels 20 and 21 that form a gear train 22. The tooth flank contact of gear wheels 20 and 21 should always be so selected that no change in contact can occur. Instead of one normal transfer cylinder, the printing unit 1 and/or 2 may include a sheet turning drum to turn over the printed sheets to print on their back sides.

The printing press drive includes a plurality of power drive units 23–26 that transmit a rotational torque from the main shaft 19 to drive gears 31. The rotational torque to the drive gear 31 is transmitted via spur pinion 27, spur gear 28, spur gear section 29, and a spur pinion 30. The drive gear 31 of the printing unit 3 is connected with a torsion spring 32 by a form locking connection. The torsion spring 32 is also connected with the axle of the gear wheel 20. The drive gears 31 of the printing units 4, 6, and 8 are also connected with respective torsion springs 33.

Metering of applied power is effected by corresponding sizing of torsion springs 32, 33. Thus, a high rotational torque is communicated to the printing cylinder 13 of the printing unit 3 via the first drive unit 23, which may, i.e., in four time exceed the power capacity required for the printing unit 3. The excess power is transmitted via the gear train 22 to printing units 2 and 1. Thus, for this gear train, a reliable abutment of tooth flanks is insured. In the printing cylinders 13 driven by drive units 24–26 a smaller, i.e., a twofold power capacity is stored, so that the power flux continues to the last printing unit. Thus, advantageously, maximum a twofold power capacity is transmitted via the gear train 22, and respective gear wheels 20 and 21 of the gear train 22 can be made identical whereby a long life of the drive is achieved.

Figure 2:
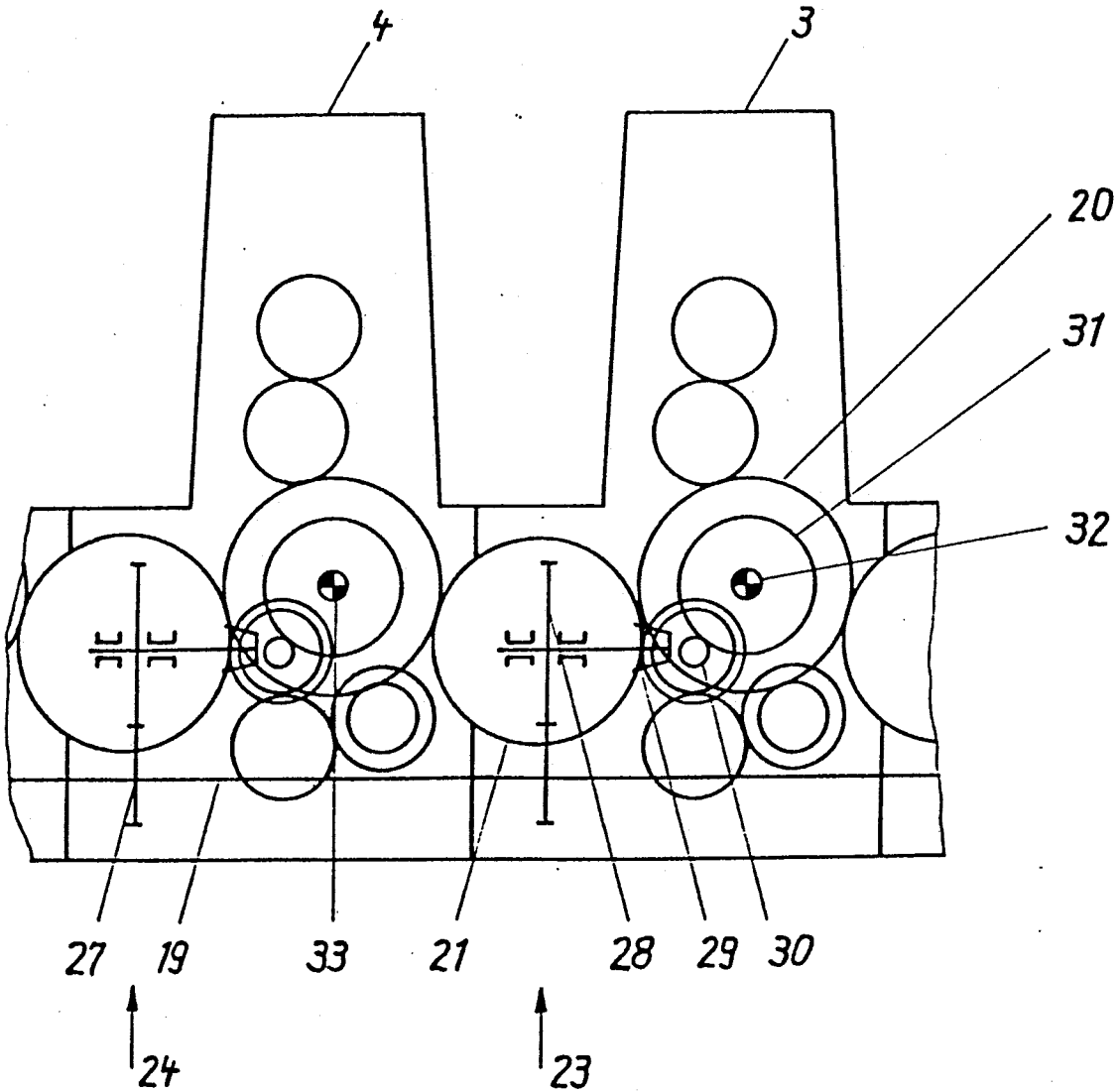
FIG. 2 shows a schematic view of two adjacent printing units equipped with respective drive units.
Figure 3:
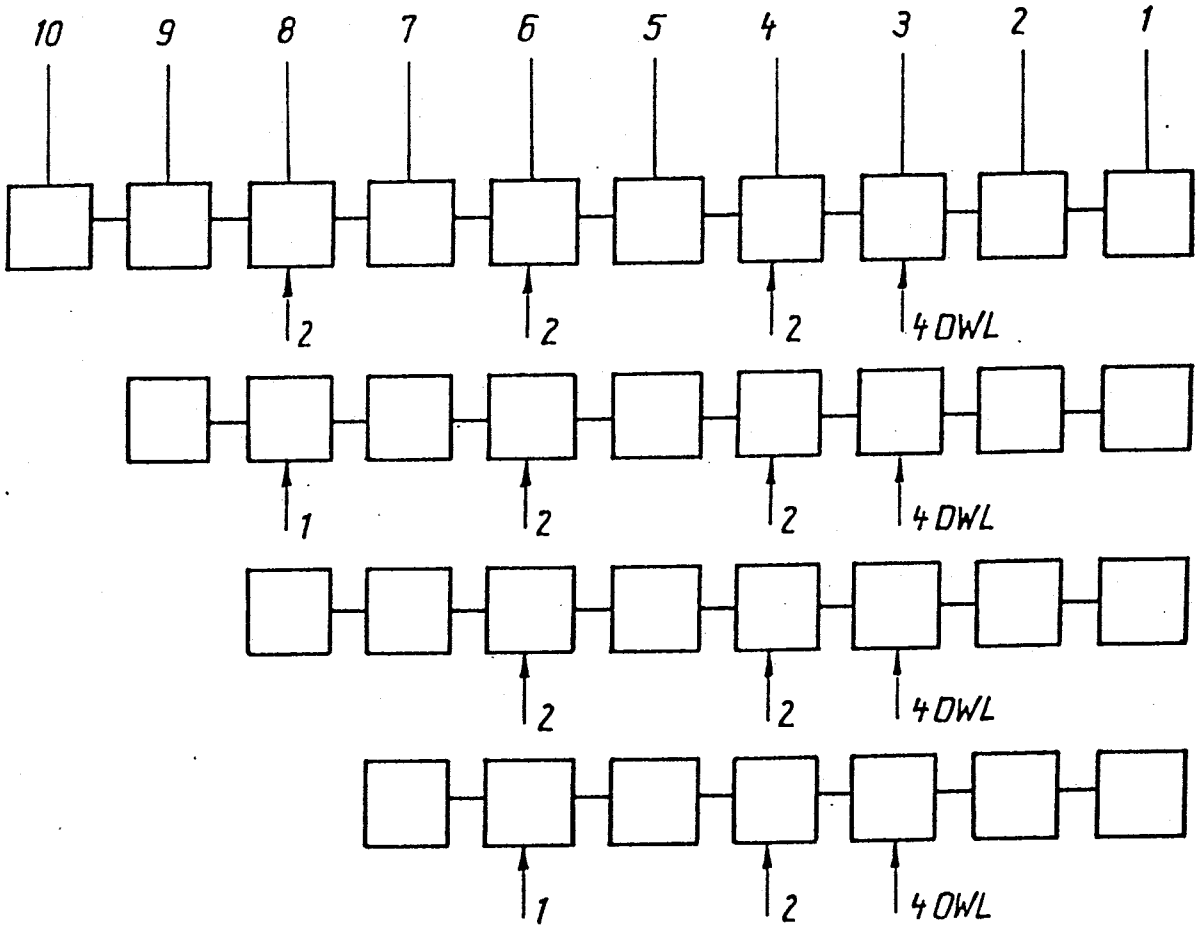
FIG. 3 shows arrangement of drive units for a rotary sheet printing press with more than six printing units.

FIG. 3 shows a drive for a multi-color rotary sheet printing press with more than six printing units. In this press, the printing unit 3 is driven with a fourfold power capacity, and the adjacent printing unit 4 is driven with a twofold power capacity. With even number of printing units, the printing units 6 and 8 will be driven with a double power capacity. With odd number of printing units, the printing units 6–8 will be driven with a single power capacity. When torsion springs with a greater power capacity than those in FIGS. 1–3, are used, the driving members are shifted to the delivery end, and loading of the following gear wheels increases.

While the invention has been illustrated and described as embodied in a drive for a multi-color rotary sheet printing press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A drive for a multi-color rotary sheet printing press having a row of printing units comprising more than six printing units and including feed and delivery printing units and intermediate printing units, said drive including a plurality of closed gear trains composed of toothed gears and connecting the printing units with each other; a plurality of power input elements for applying rotational torque to some of said intermediate printing units; and a plurality of drive trains for transmitting a rotational torque to said power input elements, said plurality of power input elements comprising two power input elements for applying torque to two neighboring intermediate printing units, so that said two neighboring intermediate printing units are driven with different power and one of said neighboring intermediate units obtains four times the power capacity required for said one printing unit, while another of said two neighboring intermediate printing units obtains two times power capacity required for said another printing unit, said feed delivery printing units being not driven, said printing units including a first printing unit and a second printing unit located one after the other at one side of said two neighboring intermediate printing units, said printing units also including two further printing units which are not driven and located at an opposite side of said two neighboring intermediate printing units and also including two additional printing units which are driven and follow said further printing units, said delivery unit and a preceding printing unit located before said delivery unit being driven from said gear trains, and a further printing unit located before said preceding unit being driven by one of said drive trains.

2. A drive as defined in claim 1, wherein said row of printing units includes an even number of said printing units, and said additional printing units are driven with two times power capacity required for said additional printing units.

3. A drive as defined in claim 1, wherein said row of printing units includes an odd number of said printing units and said additional printing units are driven with one time power capacity, said printing units including a last printing unit which is located before said feed printing unit and is not driven.

4. A drive as defined in claim 1; and further comprising a main shaft, said power input elements being connected with said main shaft through said drive trains.

5. A drive as defined in claim 1, wherein each of said intermediate printing units includes a printing cylinder and a sheet transfer cylinder, each of said gear trains including a first gear wheel connected with said printing cylinder of a respective printing unit and a second gear wheel connected with said sheet transfer cylinder of the respective printing unit and engaging said first gear wheel, said second gear wheel of each printing unit engaging said first gear wheel of a respective following printing unit.

6. A drive as defined in claim 4, wherein each of said power input elements has a drive gear connected with a respective drive train and a power transmitting element connecting said drive gear with a respective intermediate printing unit.

7. A drive as defined in claim 6, wherein said transmitting element is formed as a torsion spring.

8. A drive as defined in claim 7, wherein said torsion springs have different sizes.

* * * * *